United States Patent [19]

Jackson

[11] Patent Number: 4,838,362

[45] Date of Patent: Jun. 13, 1989

[54] APPARATUS FOR MANIPULATING A TOOL

[75] Inventor: Eric A. Jackson, Swanwick, United Kingdom

[73] Assignee: Anderson Strathclyde plc, Sheffield, United Kingdom

[21] Appl. No.: 234,304

[22] Filed: Aug. 19, 1988

[30] Foreign Application Priority Data

Aug. 25, 1987 [GB] United Kingdom ..... 8719991

[51] Int. Cl.[4] ..... E21C 9/00

[52] U.S. Cl. ..... 173/36; 173/9; 173/38; 173/160

[58] Field of Search ..... 173/4, 5, 7–9, 173/18, 36, 38, 152, 157, 160, 161

[56] References Cited

U.S. PATENT DOCUMENTS

| | | | |
|---|---|---|---|
| 4,328,872 | 5/1982 | Orthwein | 173/160 |
| 4,442,905 | 4/1984 | Agoston | 173/36 |

FOREIGN PATENT DOCUMENTS

| | | | |
|---|---|---|---|
| 480834 | 10/1975 | U.S.S.R. | 173/36 |
| 459604 | 1/1937 | United Kingdom . | |
| 725209 | 3/1955 | United Kingdom . | |
| 1377809 | 12/1974 | United Kingdom . | |
| 2093380 | 9/1982 | United Kingdom . | |
| 2113126 | 3/1983 | United Kingdom . | |

*Primary Examiner*—Frank T. Yost
*Assistant Examiner*—James L. Wolfe
*Attorney, Agent, or Firm*—Thomas W. Speckman

[57] ABSTRACT

Apparatus for manipulating a tool which is particularly suited for use in drilling and inserting bolts into thin seams of mine workings. The apparatus (100) comprises a reaction support member (4) to support the tool, a chuck (1) for holding the tool, mounting member (12) in which the chuck (1) is mounted, and a lever linkage (13) connected between the mounting member (12) and the support member (4). The lever linkage (13) comprises parallel chuck orienting members (5, 10) connecting the mounting member to a control member (9), said control member being adapted to manipulate the chuck orienting members and to control the orientation of the chuck. The lever linkage further comprises first and second links (14, 15) each having first and second ends. The links are pivotally attached to each other at the first ends thereof. The first link is pivotally attached at the second end thereof to the mounting member and the second link is pivotally attached at the second end thereof to the support member. The apparatus also comprises a moving device arranged to supply a force to the first ends of the links to cause movement of the mounting means.

16 Claims, 2 Drawing Sheets

APPARATUS FOR MANIPULATING A TOOL

BACKGROUND OF THE INVENTION

1. Field of the Invention

This invention relates to apparatus for manipulating a tool, especially a rotary tool, for example a drill.

2. Description of the Prior Art

In the mining and allied industries it is often necessary to consolidate the roof of a shift by inserting bolts. This is carried out by drilling holes in the roof, and inserting bolts which are then tightened. Resin can be used in order to ensure that the bolts are secure.

In shafts where the roofs are high this does not present a problem since conventional drilling machines can be used. However, in shafts with low roofs it is ofen not possible to use conventional drilling machines.

SUMMARY OF THE INVENTION

It is an object of this invention to provide apparatus to obviate the above problems.

According to this invention there is provided apparatus for manipulating a tool comprising a reaction support member which can rest against a support surface to provide a reaction support for the tool, a chuck for holding the tool, mounting means in which the chuck is mounted, moving means for moving the mounting means towards and away from the support member, and a lever linkage connected between the mounting means and the support member, wherein said lever linkage can be manipulated to guide the movement of the mounting means.

Preferably, the linkage comprises parallel chuck orienting members to orient the chuck and to connect the mounting means to a control member. Preferably, the linkage comprises outer and inner parallel chuck orienting members, each chuck orienting member, being pivotally attached at a first point thereon to the mounting means and at a second point thereon to the control member. The control member may be adapted to manipulate the guide members and to control the orientation of the chuck.

Preferably, the linkage also comprises at least first and second links each having first and second ends. The links may be pivotally attached to each other at the first ends. The second end of the first link may be pivotally attached to the mounting means and the second end of the second link may be pivotally attached to the support member.

Conveniently, the moving means is adapted to supply a force to the first ends of the links to cause the movement of the mounting means. The moving means may comprise an hydraulic cylinder, an elongate member having a screw thread, or any other suitable means.

The lever linkage may further comprise a connecting link to connect the reaction support member to the control member.

The control member may comprise a control plate disposed parallel to the chuck. Preferably, the chuck orienting members are arranged so that the chuck remains parallel to the control plate at all times.

In one embodiment of this invention, the apparatus comprises a support strut for the tool. Desirably, the support strut can rest, at one end thereof against the support surface, and the support strut may be pivotally attached to one of said parallel orienting members, preferably the outer orienting member, at said first point on said orienting member.

In the one embodiment, the connecting link may be provided with guide means to guide the support strut when the chuck is moved towards and away from reaction support member. Preferably, the support strut is adapted to engage slidingly the guide means.

The apparatus may further comprise first control means to control the moving means. Conveniently, the first control means is reversible.

Conveniently, the chuck can hold a rotary tool and a drive means may be provided to drive the chuck to cause the chuck and the tool to rotate.

The apparatus may also comprise second control means to control the drive means.

Conveniently, at least one handle is provided which may be attached to the control plate. The first and second control means may also be attached to the plate for ease of operation.

The mounting means may comprise a gymbal to allow the chuck to swivel.

Conveniently the lever linkage comprises two sets of links, chuck orienting members and connecting members. The sets are attached at each side of the mounting means, support member and control plate. This adds rigidity to the apparatus and reduces torsion.

The support member may comprise a base, which may comprise a base plate.

The mounting means may define an elongate aperture so that the position of the mounting means can be adjusted.

DESCRIPTION OF THE PREFERRED EMBODIMENTS

Figure 1:
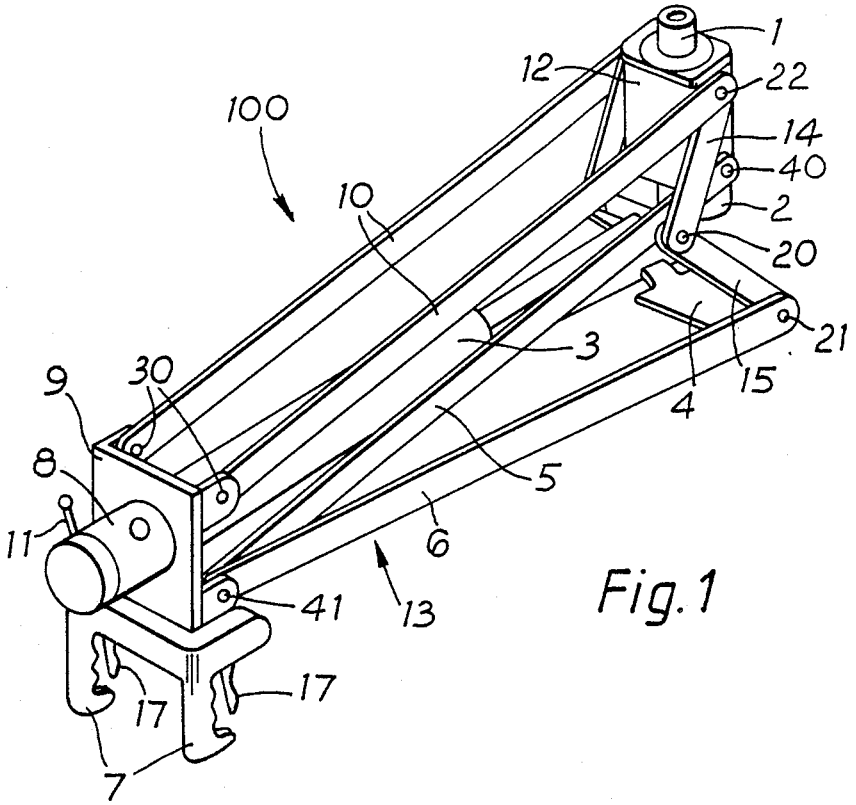
FIG. 1 is a perspective view of apparatus in accordance with this invention.
Figure 2:
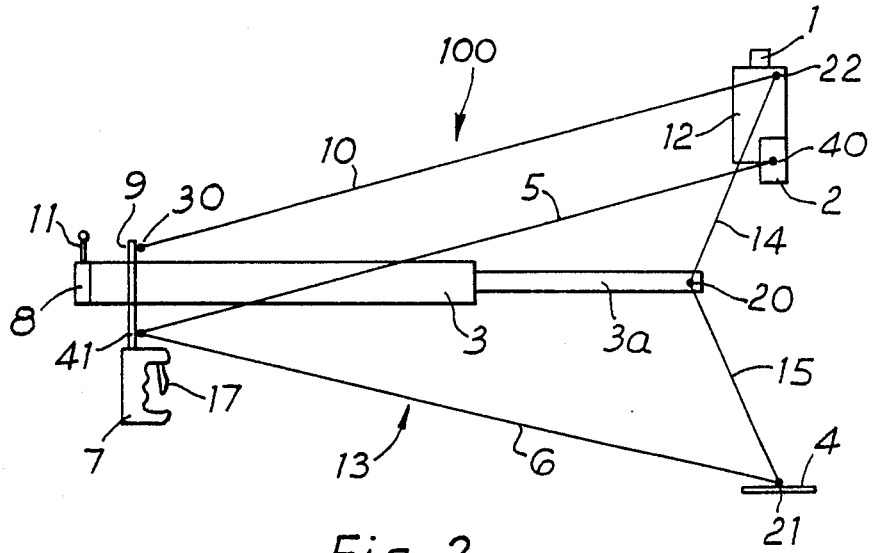
FIG. 2 is a schematic diagram of a side view of apparatus according to one embodiment of the invention.

Referring to the drawings apparatus for manipulating a tool is shown generally designated 100. The apparatus 100 is suitable for use in drilling holes in roofs in mine workings.

The apparatus 100 comprises a reaction support member in the form of a base plate 4 which can rest against the ground, and a chuck 1 for holding the tool (not shown) in the form of a drill bit or bolt. The chuck 1 is mounted in a mounting means which may be in the form of a gymbal 12.

The apparatus 100 also comprises moving means in the form of an hydraulic cylinder 3 or an elongate member having a screw thread. The hydraulic cylinder 3 has a pistion 3*a*.

First control means 8 is provided to control the hydraulic cylinder 3. The control means 8 comprises a switch 11 to reverse the hydraulic cylinder 3.

A control member in the form of a control plate 9 is also provided. Connected between the gymbal 12 and the control plate 9 is a lever linkage 13.

The lever linkage 13 comprises two pairs of parallel outer and inner chuck orienting members. In the embodiment shown, the outer chuck orienting members constitute upper chuck orienting members 10 and the inner chuck orienting members constitute lower chuck orienting members 5. The upper orienting members 10 are pivotally connected between the top of the gymbal 12 at a first point 22 on upper orienting members 10 and the top of the control plate 9 at a second point 30. The lower orienting members 5 (only one shown) are pivotally attached between the bottom of the gymbal 12 at a first point 40 on the lower orienting members 5 and the bottom of the control plate 9 at a second point 41 on the lower orienting members 5. The upper and lower orienting members 10, 5 act to maintain the gymbal 12 parallel with the control plate 9.

The lever linkage 13 also comprises a pair of first and second links 14 and 15. The first links 14 are pivotally attached to the gymbal 12 at the points of attachmemt 22 of the upper orienting members 10.

The second links 15 are pivotally attached to the first links 14 at the point 20 and to the base plate 4 at point 21.

The lever linkage 13 further comprises a pair of connecting links 6. The connecting links 6 are connected to the base plate 4 and the control plate 9. The connecting links 6 are pivotally connected to the base plate 4 at the points of attachment thereto of the second links 15 i.e. at points 21 and to the control plate 9 at the points of attachment thereto of the lower orienting members 5 i.e. at points 41.

The apparatus 100 also comprises drive means in the form of a motor 2 to rotate the chuck 1 and drill bit. The motor 2 is of any type which is well known in the art.

The apparatus 100 further comprises second control means which can comprise switches 17 to control the motor 2 which are provided on handles 7. The handles 7 are directed downwardly and are used to manipulate the lever linkage 13 to guide the gymbal 12.

Figure 3:
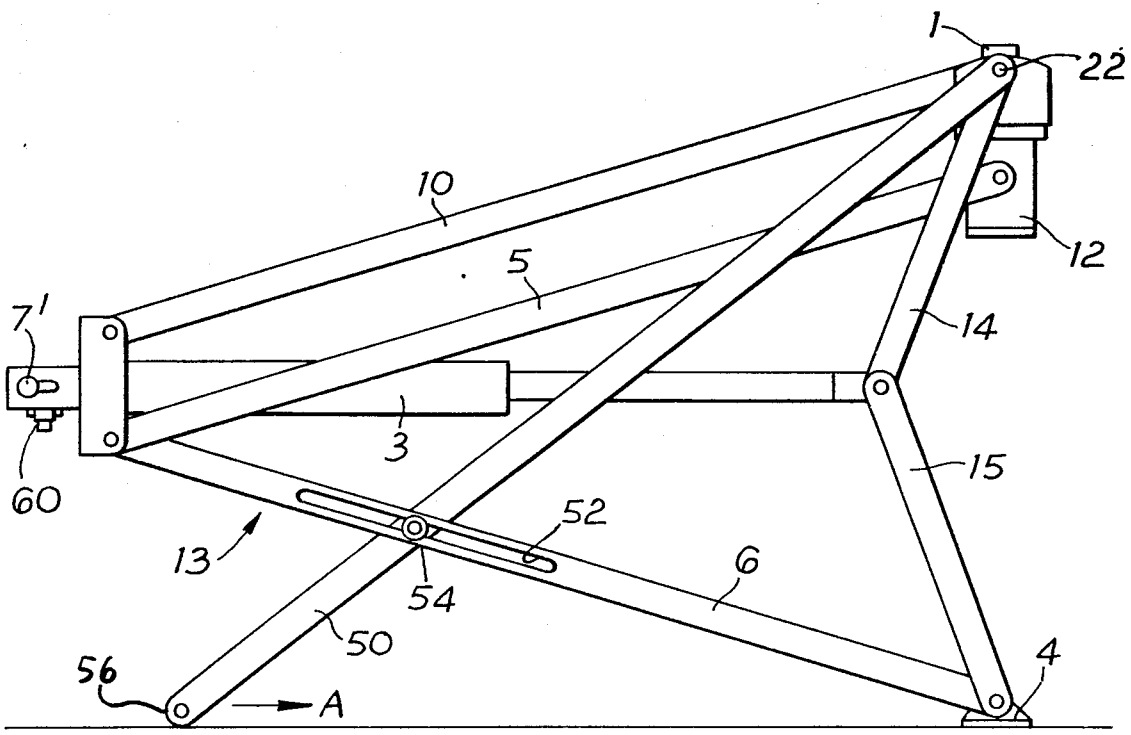
FIG. 3 is a side view of apparatus according to one embodiment of the invention.

As an alternative to the handles 7 being directed downwards, FIG. 3 shows handles 7' being directed out to the sides. The control means 8 can be control valves in the form of poppit valves which can lie in line with the handles. Also, shown in FIG. 3 is a connector 60 to connect the feed and return hose for the hydraulic cylinder 3. Although in FIG. 3, the connector 60 is directed downwards, it will be appreciated that the connector 60 can be disposed at any other suitable position.

In one embodiment, a pressure balance valve (not shown) can be fitted to the hydaulic cylinder 3. This pressure balance valve prevents creep of the piston **3*a* when the hydraulic cylinder 3** is not actuated.

This invention will now be described in operation.

A drill bit (not shown) is fitted into the chuck 1 by the operator (not shown) and the apparatus 100 is positioned underneath the point where the roof is to be drilled.

The operator selects the drill speed by means of the switches 17 to control the motor 2. The first control means 8 is operated to operate the hydraulic cylinder 3 and to apply a force to the point 20 of attachment of the first and second links 14 and 15. This causes the ends of the links 14 and 15 attached at points 21 and 22 to move apart and thus raising the gymbal 12 and the drill bit.

By continuing to apply the force on the point 20 by the hydraulic cylinder 3, the drilling is commenced through the roof. The angle of the drill is manipulated by means of the handles 7 which control the angle of the control plate 9.

The chuck orienting members 5 and 10 act to ensure that the chuck 1 is maintained parallel with the control plate 9 thus to transfer the guiding movements of the control plate to the chuck. It will be appreciated that, by varying th angle of the control plate 9 by the handles 7 the angle of drilling can be varied as desired.

Once the apparatus has reached its full height i.e. the links 14 and 15 are fully extended, the links 14 and 15 are retracted by reversing the hydraulic cylinder 3 by moving the switch 11 to the reverse position (while keeping the drill rotating to assist in removing debris from the hole), and a second drill bit can be fitted.

The operation described above can then be repeated as necessary either using progressively longer drill bits or by coupling additional short bits to the rear of the original bit to drill to the desired depth.

As soon as the desired depth is reached links 14 and 15 are retracted as described above and the drill bit removed from the chuck 1.

In the next stage of the operation, capsules of resin, well known in the art, are inserted into the drill hole. Then a roof bolt, or coupled sections of a roof bolt (not shown) are inserted into the drill hole.

The nut (not shown) of the roof bolt is inserted into the chuck 1 and the bolt is inserted further into the drill hole by operating the cylinder 3 so that the links 14 and 15 cause the chuck 1 to be raised, as described above.

As the bolt is inserted into the drill hole it is spun by operating the switches 17 which control the motor 2.

As the bolt is spun through the resin capsules the capsules are burst and the resin mixes and begins to harden. As the resin hardens the bolt is tightened by continuing to operate the motor 2.

When the tightening of the nut is complete the apparatus 100 is then moved to the position where the next hole is to be drilled and the operation described above is repeated.

Load control of the motor 2 and control of the hydraulic cylinder 3 can be incorporated into the first and second control means. In this way the load on the drill is sensed so that any excessive load causes the first control means to control the force applied by the hydraulic cylinder 3 to the point 20. This prevents the drill form stalling.

Water flushing to cool the drill bit during drilling can be made available by means of a device in the form of a water swivel.

In one embodiment of the invention the apparatus comprises a pair of support struts 50 (see FIG. 3) one end 56 of which, with the base plate 4, can rest on the ground to provide support for the tool.

The support struts 50 are pivotally attached to the first point 22 on the upper chuck orienting members 16. The connecting links 6 are each provided with guide means 52 which, in the embodiment shown in FIG. 3 are in the form of elongate apertures in each link 6 . A portion 54 of each support strut 50 is adapted to engage slidingly the guide means 52.

As the tool drills deeper into the roof, the end 56 of the support strut 50 is forced against the ground and is caused to dig into the ground which thus provides support for the tool. Furthermore, the end 56 of the strut 50 will tend to move in the direction indicated by the arrow A as the tool is drilled deeper in the roof. This causes the portion 54 of each strut 50 to move slidingly along the guide means 52.

Figure 4:
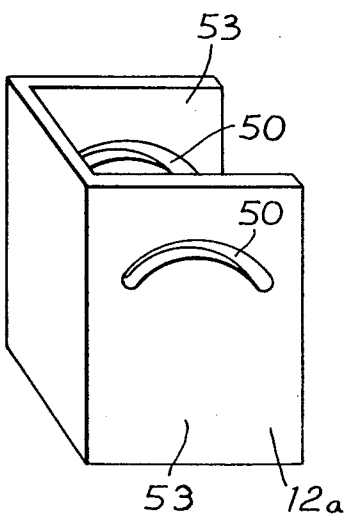
FIG. 4 is a perspective view of mounting means according to one embodiment of the invention the invention.

FIG. 4 shows a gymbal **12*a* which is similar to the gymbal 12 but which defines an aperture in the form of a curved slot 50 in each of the sides 53** of the gymbal 12*a*. The slots 50 enable the drill bit to be aligned correctly for dirlling mine workings.

The slot 50 cooperates with attaching means in the form of nuts and bolts 54 used to attach the links 10 to the gymbal 12 (see FIG. 1). By releasing the nuts and the bolts 54, the position of the gymbal 12 can be adjusted to correct any misalignment of the drill bit. When the drill bit is aligned correctly, the nuts and the bolts 54 can be retightened, and drilling can then begin.

It is an advantage of this invention that the length occupied by the components (the "dead length") is minimised. It is a further advantage that the apparatus is portable and can operate either from a separate power supply or from its own power supply; it can also be adapted to operate from the air supply of the mine shaft.

A modification to the apparatus 100 is to have the chuck 1 and adjacent the motor 2 disposed side by side to each other. The raising and lowering of the chuck could be achieved by a gear system well known in the art. The advantage of this modification is further to reduce the dead length.

Although this invention has been described for drilling roofs, it will be appreciated that it can also be used for drilling walls. In such a case, the base plate 4 and the support strut 50 would rest against the wall opposite to that being drilled.

I claim:

1. Apparatus for manipulating a tool comprising:

a reaction support member, which can rest against a support surface, to provide a reaction support for the tool;

a chuck for holding the tool;

mounting means in which the chuck is mounted;

a lever linkage connected between the mounting means and the support member, said lever linkage comprising parallel chuck orienting members;

a control member connected to the parallel chuck orienting members, said control member being adapted to manipulate the chuck orienting members to control the orientation of the chuck;

the lever linkage further comprising first and second links each having first and second ends, said links being pivotally attached to each other at the first ends thereof, the first link being pivotally attached at the second end thereof to the mounting means, and the second link being pivotally attached at the second end thereof to the support member; and moving means arranged to supply a force to the first ends of the links to cause movement of the mounting means.

2. Apparatus according to claim 1 wherein the linkage comprises a connecting link to connect the support member to the control member.

3. Apparatus according to claim 2 wherein the lever linkage comprises outer and inner parallel chuck orienting members, each of said chuck orienting members being pivotally attached at a first point thereon to the mounting means and at a second point thereon to the control member.

4. Apparatus according to claim 2 further comprising a support strut to provide support for the tool, wherein the support can rest, at one end thereof, against the support surface and wherein the support strut is pivotally attached to one of said orienting members at said first point on said orienting member.

5. Apparatus according to claim 3 wherein the connecting link is provided with guide means to guide the support strut when the chuck is moved towards and away from the reaction support member.

6. Apparatus according to claim 5 wherein the support strut is adapted to engage slidingly the guide means.

7. Apparatus according to claim 1 wherein the control member comprises a control plate and the guide members are arranged so that the chuck remains parallel to the control plate at all times.

8. Apparatus according to claim 1 wherein the moving means is adapted to supply a force to the links to cause the movement of the mounting means.

9. Apparatus according to claim 1 comprising first control means to cause the moving means to move the mounting means towards and away from the support member.

10. Apparatus according to claim 1 wherein the chuck is adapted to hold a rotary tool and a drive means is provided to drive the chuck and to cause the chuck and the tool to rotate.

11. Apparatus according to claim 10 wherein the speed of rotation of the chuck is controlled by second control means.

12. Apparatus according to claim 10 wherein the chuck and mounting means are disposed side by side the drive means.

13. Apparatus according to claim 11 wherein the first and second control means comprises load control means adapted to sense any excessive load on the tool and to control the moving means.

14. Apparatus according to claim 1 wherein the mounting means comprises a gymbal to allow the chuck to swivel.

15. Apparatus according to claim 1 wherein the support member comprises a base plate to support the load on the tool.

16. Apparatus according to claim 1 wherein the mounting means defines an elongate aperture so that the orientation of the mounting means can be adjusted.

* * * * *